US011124971B2

(12) United States Patent
Richard

(10) Patent No.: US 11,124,971 B2
(45) Date of Patent: Sep. 21, 2021

(54) REMOVABLE STAIR SYSTEM WITH RAILINGS

(71) Applicant: LES ATELIERS ADAM RICHARD INC., Montreal (CA)

(72) Inventor: Adam Richard, Montreal (CA)

(73) Assignee: LES ATELIERS ADAM RICHARD INC., Montreal (CA)

( * ) Notice: Subject to any disclaimer, the term of this patent is extended or adjusted under 35 U.S.C. 154(b) by 187 days.

(21) Appl. No.: 16/562,782

(22) Filed: Sep. 6, 2019

(65) Prior Publication Data

US 2020/0080314 A1 Mar. 12, 2020

Related U.S. Application Data

(60) Provisional application No. 62/728,266, filed on Sep. 7, 2018.

(51) Int. Cl.
*E04F 11/18* (2006.01)

(52) U.S. Cl.
CPC ..... *E04F 11/18* (2013.01); *E04F 2011/187* (2013.01)

(58) Field of Classification Search
CPC ... E04F 11/18; E04F 11/1863; E04F 11/1865; E04F 11/1834; E04F 11/1817; E04F 2011/187; A61H 3/00
See application file for complete search history.

(56) References Cited

U.S. PATENT DOCUMENTS

| | | | | | |
|---|---|---|---|---|---|
| 2,888,182 | A * | 5/1959 | Nixon | E04F 11/06 | 182/1 |
| 3,421,529 | A * | 1/1969 | Vestal | A61H 3/00 | 135/67 |
| 4,844,199 | A * | 7/1989 | Nimz | A61H 3/00 | 182/106 |
| 5,957,146 | A * | 9/1999 | Corey | A61H 3/00 | 135/65 |
| 6,279,880 | B1 * | 8/2001 | Hawks, Jr. | E04G 21/3219 | 256/67 |
| 9,091,083 | B1 * | 7/2015 | Goudreau | E04F 11/0223 | |
| 9,650,796 | B2 * | 5/2017 | Klingenberg | E04H 3/126 | |
| 2008/0209853 | A1 * | 9/2008 | Hull | E04F 11/1863 | 52/832 |
| 2016/0346157 | A1 * | 12/2016 | Barto | A61H 3/00 | |

* cited by examiner

*Primary Examiner* — Daniel J Wiley
(74) *Attorney, Agent, or Firm* — Brouillette Legal Inc.; Robert Brouillette

(57) ABSTRACT

Apparatus to equip an existing stair case with no hand railing with hand railings with the purpose of aiding a person with reduced capacity to climb up and down stairs. The apparatus includes features that permit the system to adjust to a large inventory of existing stair cases and to be installed without making any damage to existing installation. The apparatus is comprised of oversteps, railings, fixed height railing supports, adjustable height railing supports, attachments to prevent tripping, a half step and hardware to attach all the pieces together such as bolts, nuts, butterfly nuts, washers and screws. No need for repairs to existing installation once the adjustable stair system with railings is removed. The apparatus is movable, re-usable and may be installed indoors and outdoors.

19 Claims, 9 Drawing Sheets

REMOVABLE STAIR SYSTEM WITH RAILINGS

CROSS-REFERENCE TO RELATED APPLICATIONS

The present patent application claims the benefits of priority of commonly assigned Provisional Patent Application No. 62/728,266, entitled "Removable stair system with railings" and filed at the United States Patent and Trademark Office on Sep. 7, 2018.

FIELD OF THE INVENTION

The present invention generally relates to an apparatus for aiding people in walking up and down stairs where railings are not present.

BACKGROUND OF THE INVENTION

Many places, public or private, have stairs without hand railings. Such installations, if respecting the applicable construction codes and regulations, are perfectly acceptable. But people suffering from mobility issues may have difficulties going up or down stairs, even those with only two or three steps, without any means to support a part of their body weight. These difficulties limit the ability for these people to move freely in their environment without assistance.

Consequently, a need exists for an apparatus to provide railings that adjust to existing stairs in either public buildings or in private homes. In addition, there is a need for such an apparatus not to interfere with the regular activities of people who do not need such an apparatus. Furthermore, there is a need for such an apparatus to be installed temporarily and not damage existing installations that would require repairs once the apparatus is no longer necessary.

No other systems have been found that provide a temporary solution to install hand railings that adjust to existing structures to help people travel up and down stairs. Other systems have been found to reduce the height of stairs. In one example, the U.S. Pat. No. 5,355,904 describes a system to attach a half step, but it requires the installation of a fixed structure to secure it. In another example, the U.S. Pat. No. 5,318,057 discloses a half-step stability cane. The half step proposed in the present invention is used without any fixed structure.

SUMMARY OF THE INVENTION

The aforesaid and other objectives of the present invention are realized by generally providing hand railings for existing stairs that do not have any permanent railings.

The invention describes a means to install hand railings for existing stairs without any destruction or damage done to the existing installation. Preferably, the railings and posts are made in such a way that they can adjust to a range of existing conditions.

In use, such an apparatus allows a person to support a portion of their body weight and have more stability by using their hands and arms while going up and down stairs that would have been inaccessible otherwise. Further, additional embodiments utilize a half step which is present on each step to reduce the height the foot has to travel to ascend or descend.

First embodiments of the inventive apparatus comprise the use of stairs, railings, fixed height railing supports, adjustable height railing supports, attachments to prevent tripping, optional half steps and hardware to attach all the pieces together, for example, bolts, nuts, butterfly nuts, washers and screws.

In one embodiment of the present invention, the present invention relates to a stair apparatus providing temporary support for going up and down stairs, the stair apparatus comprising:

at least two oversteps,
at least one hand railing, and
at least two hand railing supports,
wherein each hand railing support comprises a first end and a second end, wherein the first end is attached to an overstep and the second end is attached to one hand railing.

The stair apparatus may be installed on top of existing stairs and may be removable or temporary.

In another embodiment of the present invention, the stair apparatus may further comprise hand railing supports of adjustable height and/or fixed height, attachments to prevent tripping, optional half steps and hardware to attach all the pieces together, for example but not limited to bolts, nuts, butterfly nuts, washers and screws.

The present invention also relates to a stair system for providing temporary support for going up and down stairs, the stair system comprising:

at least two oversteps,
at least one hand railing, and
at least two hand railing supports, each support connecting said hand railing to one overstep,
wherein the at least one hand railing comprises attachment means such as but not limited to premade holes,
wherein the at least one hand railing support comprises attachment means such as but not limited to premade slots or openings for assembly purposes, and
wherein the stair system is removable.

In another embodiment of the present invention, the stair system may further comprise an angle adjustment. The angle adjustment may be achieved but not limited to using hand railing supports of adjustable height.

In another embodiment of the present invention, the stair system may further comprise hand railing supports of fixed height and/or adjustable height, attachments to prevent tripping, optional half steps and hardware to attach all the pieces together, for example, but not limited to bolts, nuts, butterfly nuts, washers and screws.

The features of the present invention which are believed to be novel are set forth with particularity in the appended claims.

BRIEF DESCRIPTION OF THE DRAWINGS

The above and other objects, features and advantages of the invention will become more readily apparent from the following description, reference being made to the accompanying drawings in which.

DETAILED DESCRIPTION OF THE PREFERRED EMBODIMENT

A novel removable stairs apparatus and system with railings will be described hereinafter. Although the invention is described in terms of specific illustrative embodiment(s), it is to be understood that the embodiment(s) described herein are by way of example only and that the scope of the invention is not intended to be limited thereby.

Figure 1:
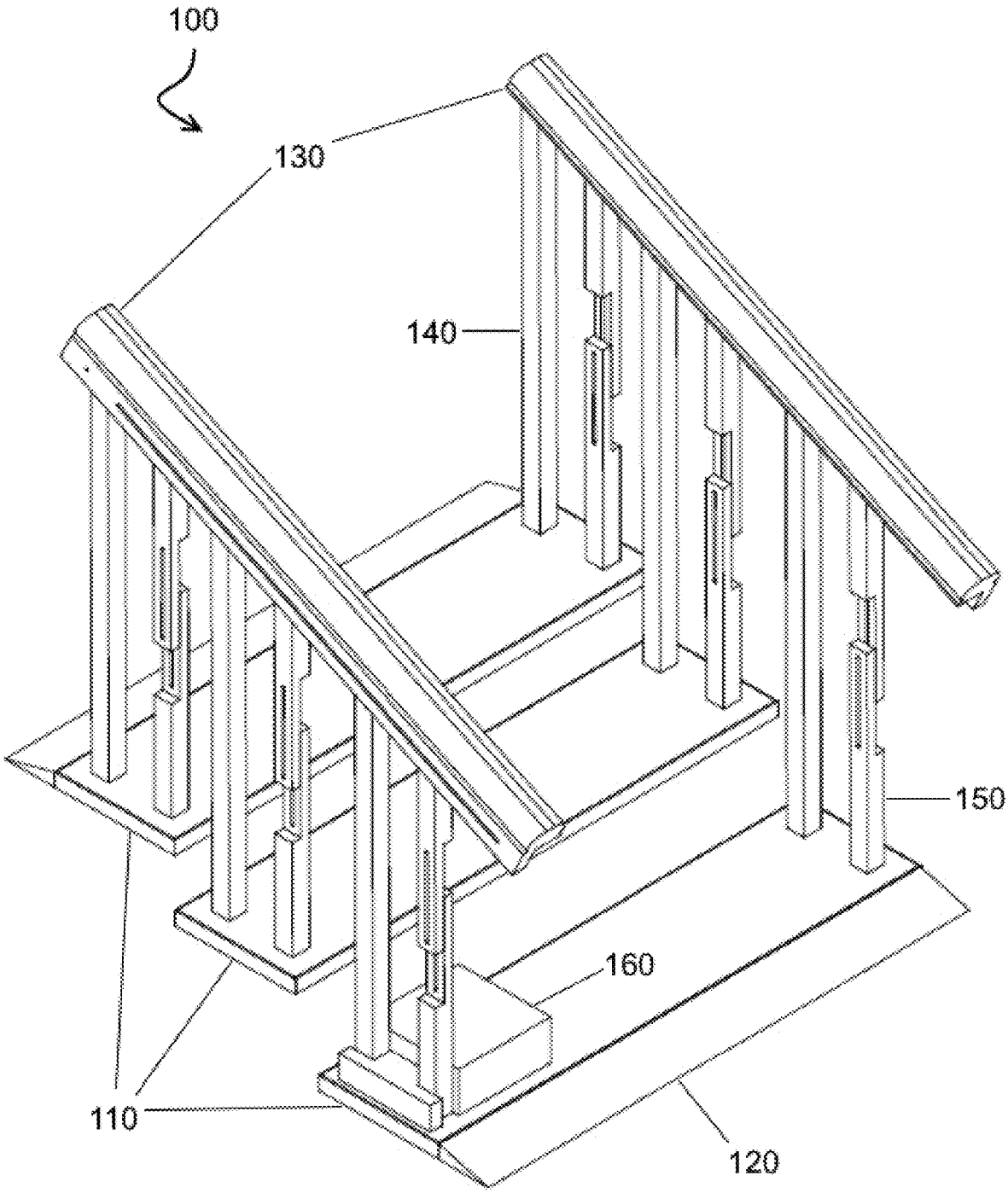
FIG. 1 is a perspective view of an embodiment of the stair apparatus in accordance with the present invention.

In a first embodiment of the present invention, FIG. 1 shows a general view of an embodiment 100 of the invention with 3 oversteps 110, the embodiment 100 comprising:

three oversteps 100, wherein the three oversteps comprise a top overstep, an intermediate overstep and a bottom overstep, two hand railings 130, and two hand railing supports 140/150 for each overstep per hand railing 130, wherein each hand railing support comprises a first end and a second end, wherein the first end is attached to an overstep 110 and the second end is attached to one hand railing 130, wherein all oversteps comprise one hand railing support of fixed height 140 and one hand railing support of adjustable height 150 attached to each hand railing 130, wherein the stair system is removable.

The embodiment 100 further comprises a top overstep, an intermediate overstep and a bottom overstep, the top and the bottom overstep 110, with an optional attachment 120 to prevent tripping. In this embodiment, the stair system may further comprise an optional half step 160 on all oversteps except for the top overstep. In this embodiment each overstep further comprises one hand railing support having a fixed height 140 and one hand railing support having an adjustable height 150 with both hand railing supports being connected to the same hand railing 130. The use of adjustable hand railing supports allows an angle adjustment of the stair system to adapt the stair system 100 to an existing stair structure.

The stair apparatus and system are not limited to the use of three (3) oversteps. The invention may further comprise fewer oversteps or more than 3 oversteps.

The stair apparatus and system are also not limited to two (2) hand railings. The invention may comprise only one hand railing or more than two hand railings.

Figure 2:
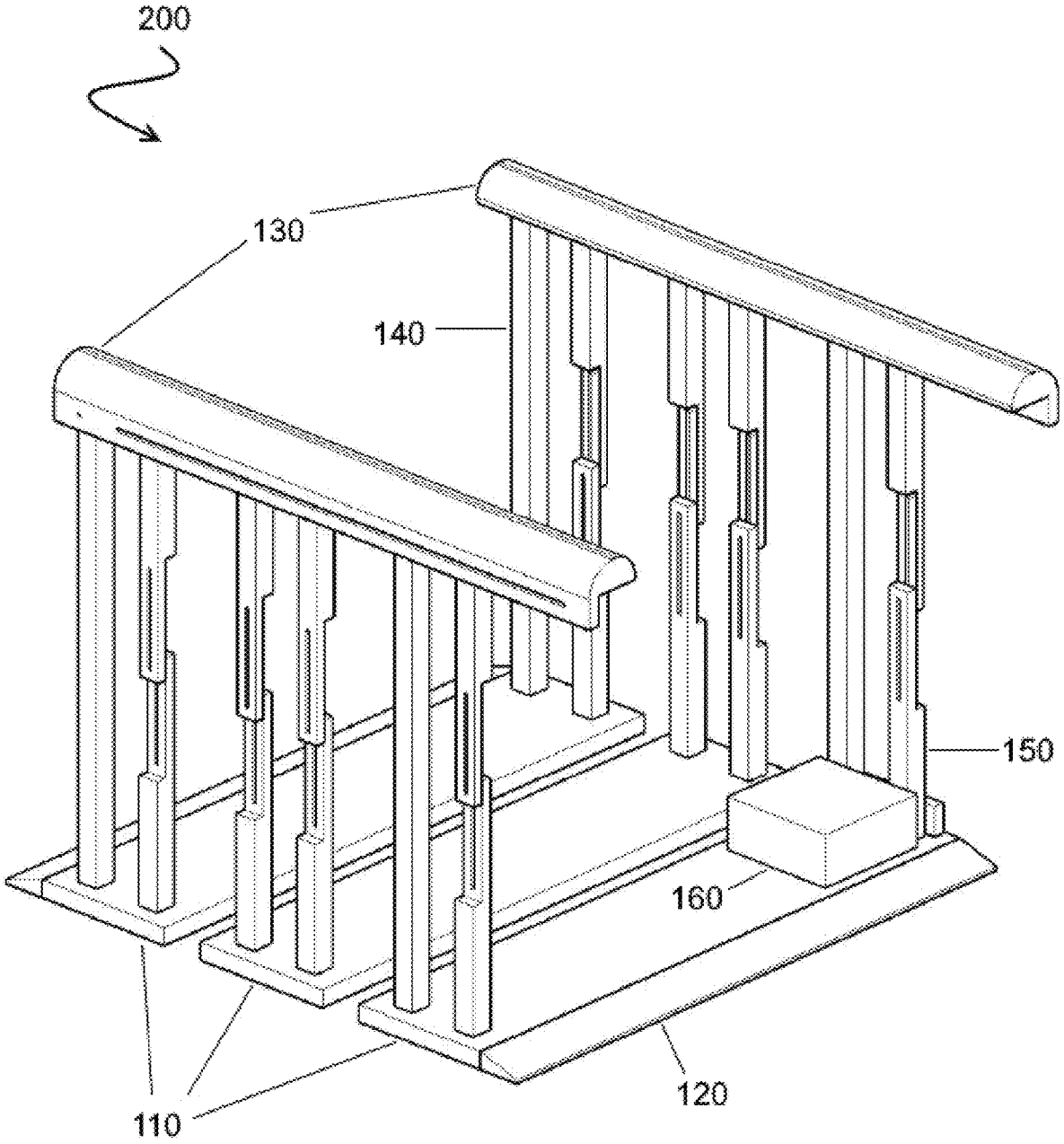
FIG. 2 is a perspective view of a second embodiment of the stair apparatus in accordance with the present invention.
Figure 3B:
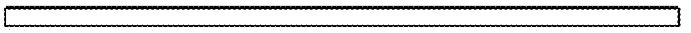
FIGS. 3A, 3B, 3C and 3D are respectively an end view, a side view, a bottom view and a top perspective view of a stair in accordance with the present invention.
Figure 3A:
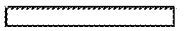
Figure 3C:
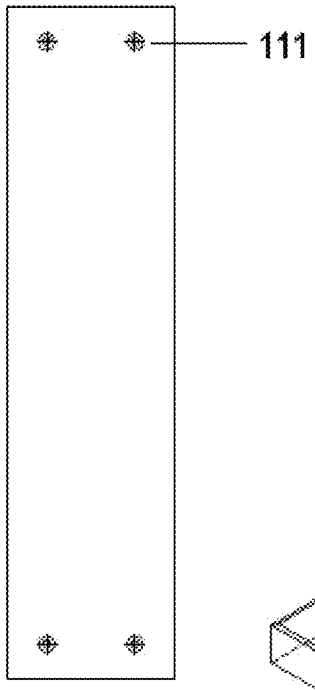
Figure 3D:
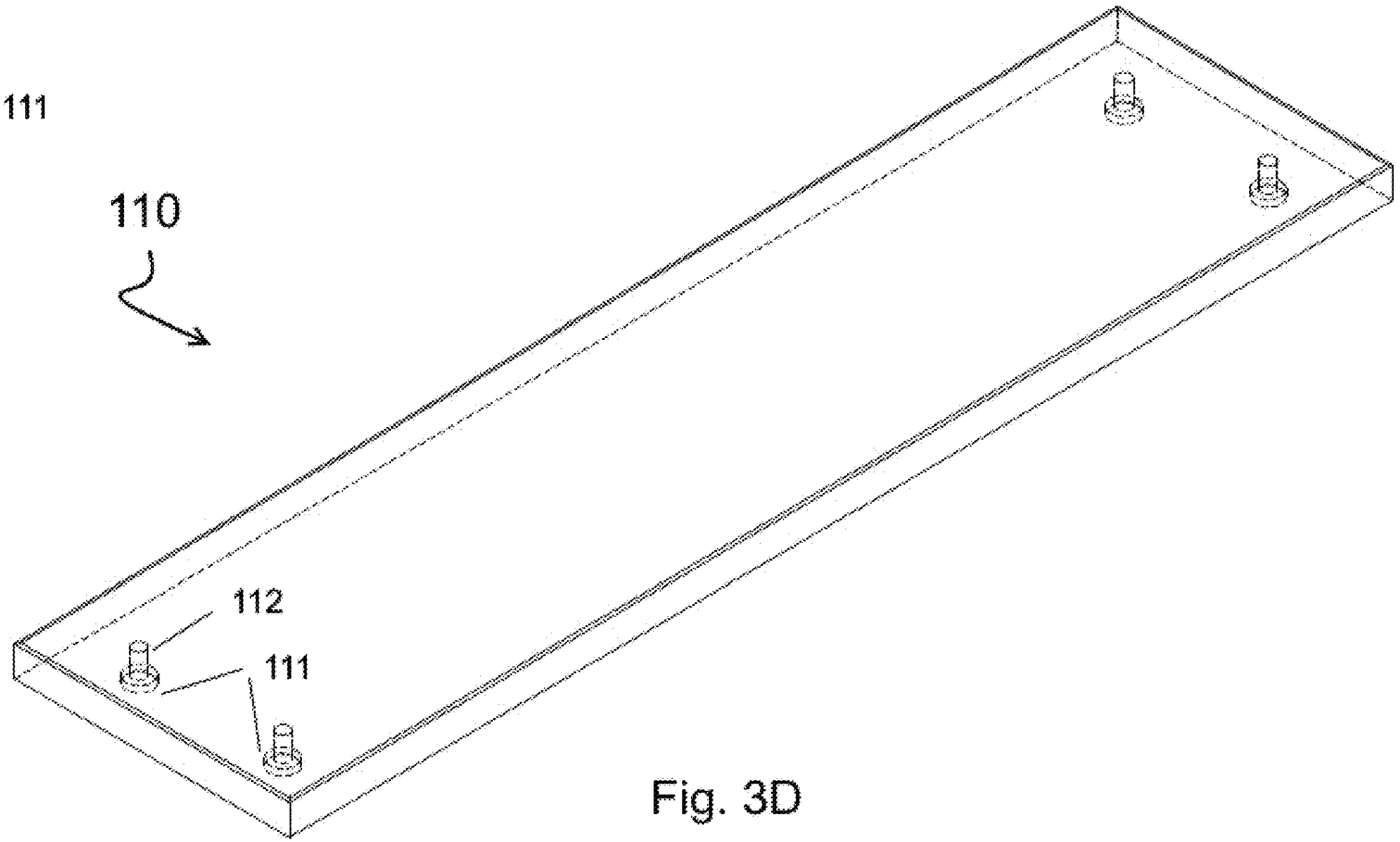
Figure 4A:
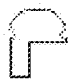
FIGS. 4A, 4B, 4C and 4D are respectively an end view, a side view, a bottom view and a top perspective view of a hand rail in accordance with the present invention.
Figure 4B:
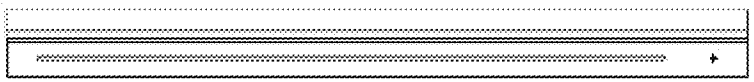
Figure 4C:
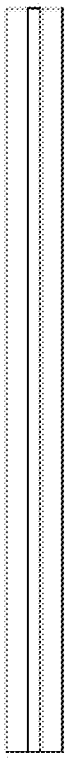
Figure 4D:
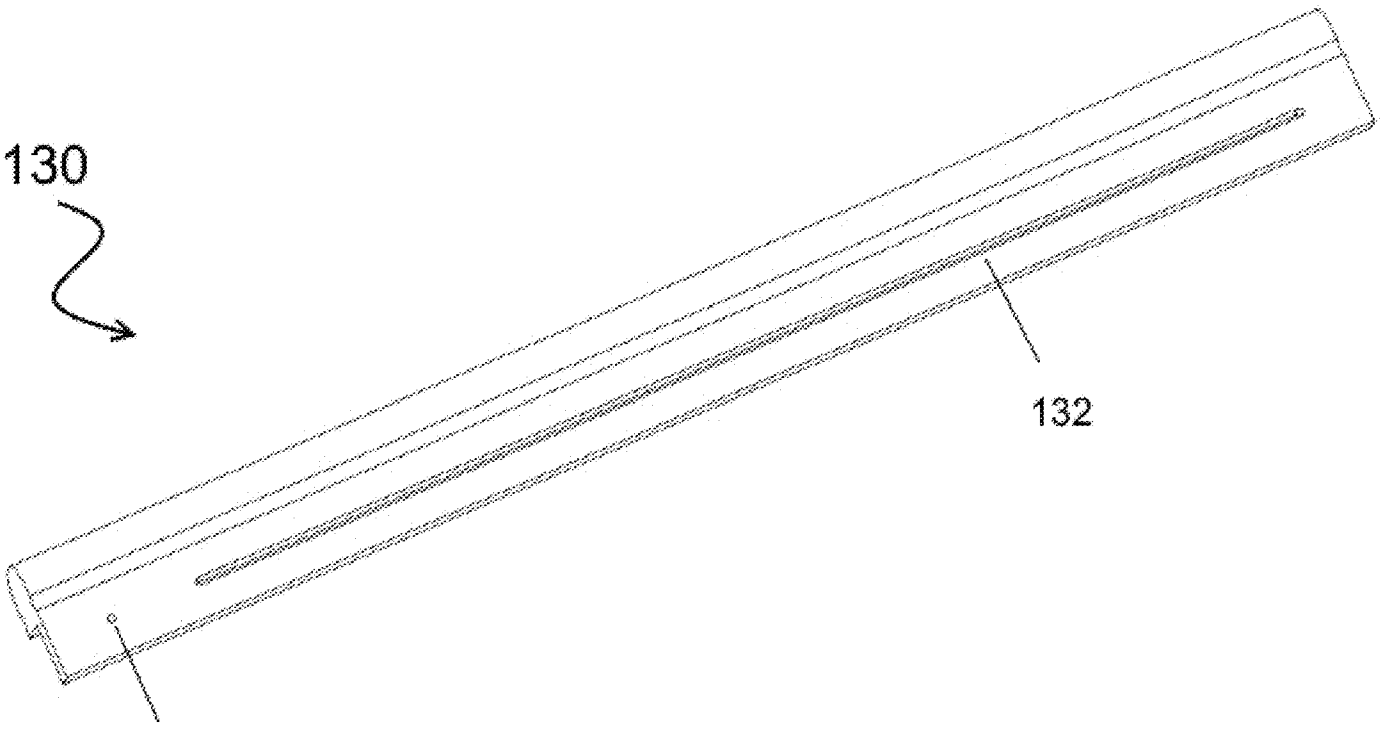
Figure 5A:
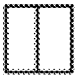
FIGS. 5A, 5B, 5C and 5D are respectively an end view, a view of a first side, a view of a second side and a perspective view of an adjustable height railing support in accordance with the present invention.
Figure 5B:
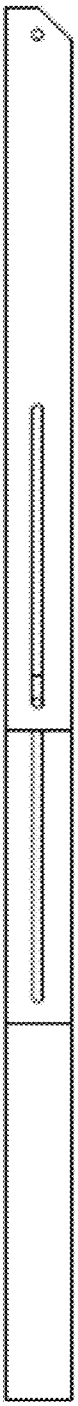
Figure 5C:
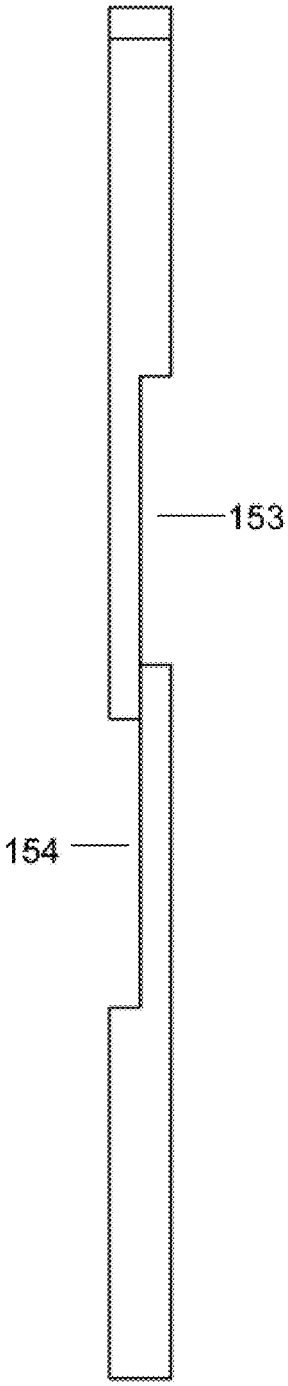
Figure 5D:
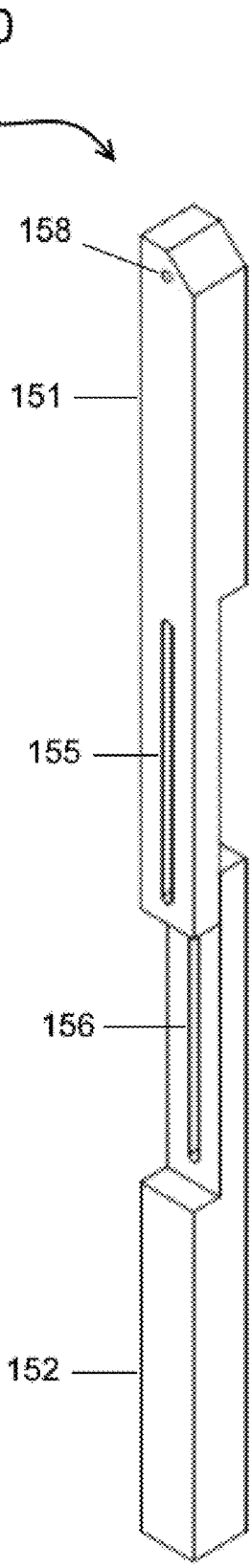
Figure 6A:
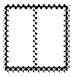
FIGS. 6A, 6B, 6C and 6D are respectively an end view, a view of a first side, a view of a second side and a perspective view of a fixed height railing support in accordance with the present invention.
Figure 6B:
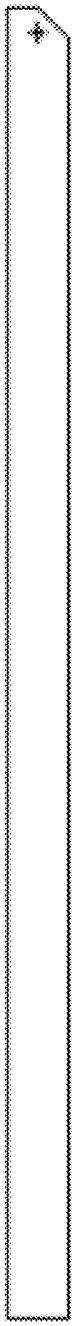
Figure 6C:
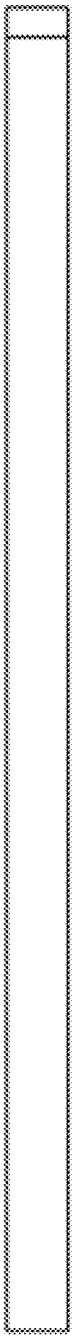
Figure 6D:
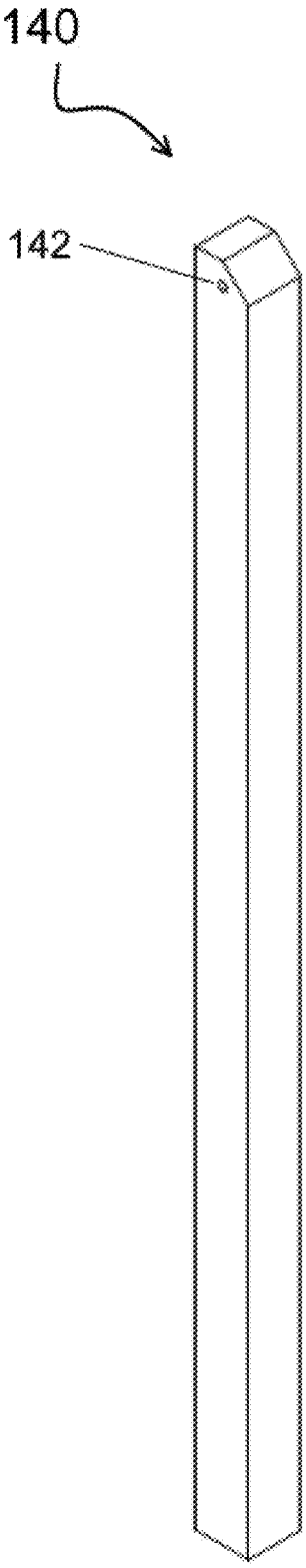
Figure 7B:
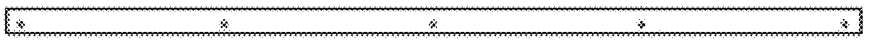
FIGS. 7A, 7B, 7C and 7D are respectively an end view, a side view, a bottom view and a top perspective view of an optional attachment to prevent tripping in accordance with the present invention.
Figure 7D:
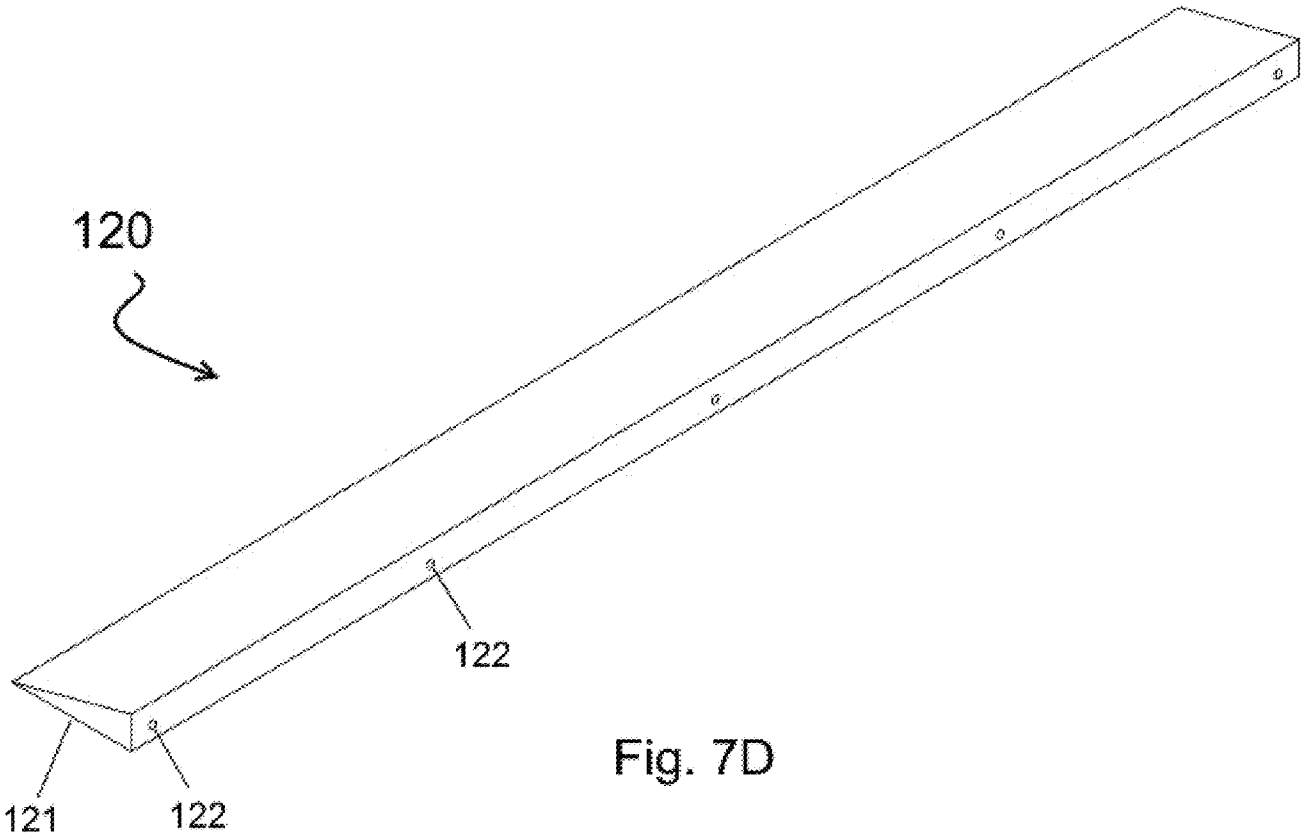
Figure 7A:
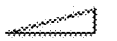
Figure 7C:
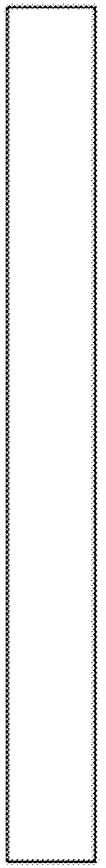
Figure 8B:
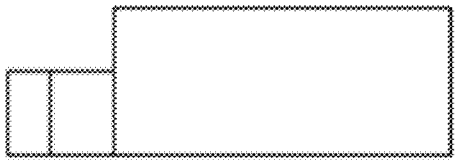
FIGS. 8A, 8B, 8C and 8D are respectively an end view, a side view, a bottom view and a top perspective view of an optional half step in accordance with the present invention.
Figure 8D:
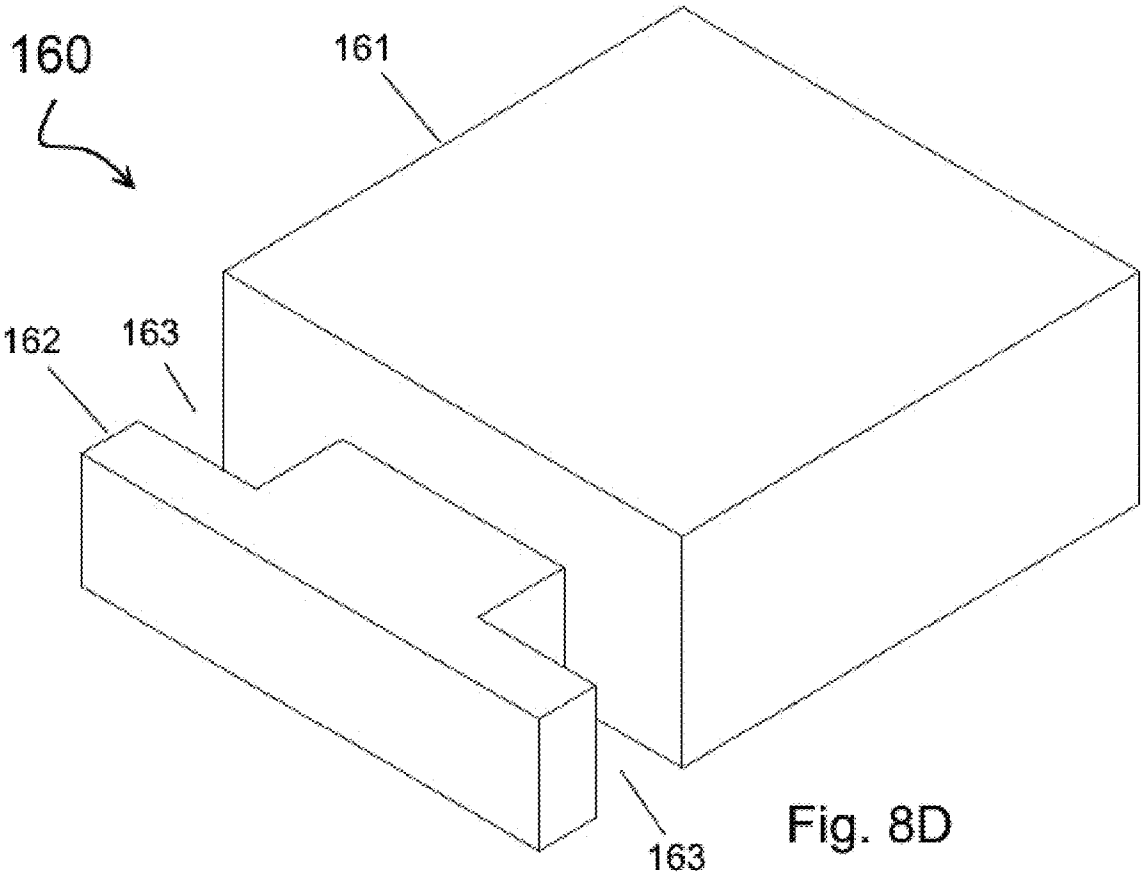
Figure 8A:
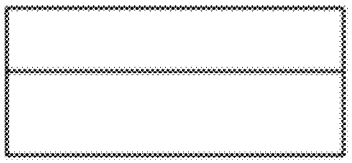
Figure 8C:
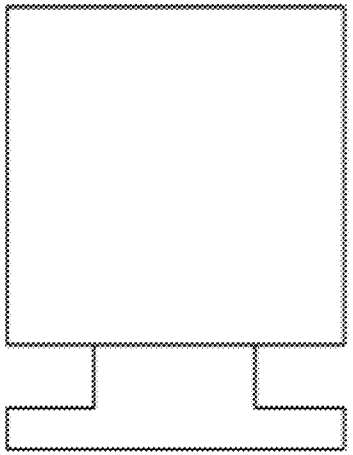

In a second embodiment of the present invention, FIG. 2 shows a general view of a second embodiment 200 of the invention with three oversteps 110, the second embodiment 200 comprising:

three oversteps 100, wherein the three oversteps comprise a top overstep, an intermediate overstep and a bottom overstep, two hand railings 130, and two hand railing supports 140/150 for each overstep per hand railing 130, wherein each hand railing support 140/150 comprises a first end and a second end, wherein the first end is attached to a overstep 110 and the second end is attached to one hand railing 130, wherein the top and bottom oversteps comprise one hand railing support of fixed height and one hand railing support of adjustable height being attached to each hand railing 130, wherein all hand railing supports attached to the intermediate overstep are of adjustable height, wherein the stair system is removable.

The second embodiment 200 further comprises a top, an intermediate and a bottom overstep. The top and the bottom overstep 110 with an optional attachment 120 to prevent tripping. The stair apparatus and system further comprises two (2) hand railings 130, each hand railing comprising six supports, being two supports per overstep. In this second embodiment, all hand railing supports attached to the intermediate overstep are of an adjustable height 150. The use of adjustable hand railing supports only in all intermediate oversteps allow the stair apparatus to better adapt to an existing stair system when the existing oversteps are of different heights. In this case, a stair system with hand railing supports of adjustable heights located on the intermediate oversteps allows a better angle adjustment over the existing stair structure. The embodiment 200 may further comprise optional half steps 160 on all steps except for the top step.

In another embodiment of the present invention, FIGS. 3A to 3D show a step 110 made in accordance with the present invention. The step may be placed on the floor or over a step of an existing stair. The overstep may further comprise fixation means to allow fixation of hand railing supports to the overstep. The fixation means may be but not limited to holes 111 to allow fixation of the hand railing step with the use of but not limited to screws 112. The overstep may further comprise one hole or slot per hand railing support. The overstep may further comprise attachment means to provide fixation of an optional attachment 120 to prevent tripping. The optional attachment 120 to prevent tripping may be installed to a top or a bottom overstep 110.

In another embodiment of the present invention, FIGS. 4A to 4D show the hand railing 130 featuring a slot 132 to allow the flexibility of the system, made in accordance with the present invention. The slot 132 allows the fixation of the hand railing supports 140/150. The hand railing 130 may further comprise a hole or slot 138 to allow fixation of the hand railing support located on the top overstep, said railing support being the first support of the stair system.

In another embodiment of the present invention, FIGS. 5A to 5D show the adjustable height railing support 150 featuring a slot to allow the flexibility of the system, made in accordance with the present invention. The adjustable hand railing support 150 may further comprise a top portion 151 and a lower portion 152. The top and lower portions further comprise slot portions 153/154 to allow an adjustment of the height of the hand railing support. The slot portions may further comprise sliding means 155/156 to allow the fixation of the top and the bottom portions to each other at the desired height. The hand railing support of adjustable height 150 may further comprise attachment means such as but not limited to a hole or a slot 158 to allow fixation of the hand railing 130 to the hand railing support 150.

In another embodiment of the present invention, FIGS. 6A to 6D show the fixed height railing support 140 made in accordance with the present invention. The fixed height railing support 140 may further comprise fixation means to allow the hand railing support 140 to be attached to the overstep 110 and the hand railing 130. The hand railing support of fixed height 140 may further comprise attachment means such as but not limited to a hole or a slot 142 to allow fixation of the hand railing 130 to the hand railing support 140.

In another embodiment of the present invention, FIGS. 7A to 7D show the optional attachment 120 to prevent tripping made in accordance with the present invention. The optional attachment may further comprise attachment means such as but not limited to holes or slots 122 to allow fixation of the optional attachment to the top overstep and the bottom overstep. The optional attachment may be of but not limited to a triangular shape 121 comprising rectangular surfaces.

In another embodiment of the present invention, FIGS. 8A to 8D show the optional half step 160 made in accordance with the present invention. The half step further comprises a step portion 161 and an anchoring portion 162. The step portion may be but not limited to a cube shape comprising surfaces that may be of a rectangular or square shape. The anchoring portion 162 may be of a lower height than the height of the cube portion and may be located on a side surface of the cube portion. The half step may further comprise two slots 163 or opening spaces to allow the fitting of hand railing supports. The anchoring portion may be of but not limited to a T-shape. The anchoring portion allows the fixation of the half step in between two hand railing supports or existing supports of an existing stair structure.

In an embodiment of the present invention, each overstep 110 (as shown in FIG. 2A-D) may be equipped with hand railing supports 140/150, half of them being fixed height 140 (as shown in FIGs. 6A-6D) and the other half being adjustable height 150 (as shown in FIG. 5A-5D). The hand railing supports 140/150 may be attached to the overstep 110 from under the overstep through the premade holes with the appropriate hardware. Underneath the overstep 110 a non-skid rubber may be installed to prevent movement between the adjustable stairs system with railings and the existing stairs. Other means may be installed as an anti-skidding device or an adherent surface to improve safety.

In another embodiment of the present invention, the hand railings 130 (as shown in FIG. 4A-4D) may be attached to the hand railings supports 140-150 through the hole 142/158 near the top end of the hand railing support and the openings in the hand railings 130. The first hand railing support 140 located at the top of the stair system 100 (as shown in FIG. 1), may be attached to the hand railing 130 to the premade hole 142 with the appropriate hardware. The subsequent hand railing supports 140-150 are subsequently attached to the hand railings 130 (as shown in FIG. 3) through the premade slot with the appropriate hardware. The length of the hand railings 130 (as shown in FIG. 3) is determined by the number of oversteps 110 required.

In another embodiment of the present invention, the attachments 120 (as shown in FIGS. 1, 2 and 7A-7D) may be optionally fixed to the bottom or first and the top or last oversteps 110 to prevent tripping.

In another embodiment of the present invention, a half step 160 (as shown in FIG. 7) may be optionally installed on each overstep to reduce the height the user has to climb. The half step 160 (as shown in FIG. 7) may be fixed on the overstep by wedging it through the hand railing supports 140-150, or by any other means (example: straps) if used with existing posts.

In another embodiment of the present invention, once all the parts are assembled: oversteps 110, hand railing supports 140, 150, hand railings 130 (as shown in FIG. 3) and attachment 120, the removable and adjustable stair system 100/200 with railings 130 may be installed on an existing structure. The hand railings 130 may be further adjusted automatically to the correct angle and the adjustable hand railing supports 150 may be further adjusted automatically to the correct length. Following the installation, all the hardware comprising but not limited to bolts, nuts, butterfly nuts, washers and screws may be tightened.

In another embodiment of the present invention, the hand railings 130 may have grooves to allow a tighter grip and prevent skidding of the hands thus helping in preventing a fall.

Figure 9:
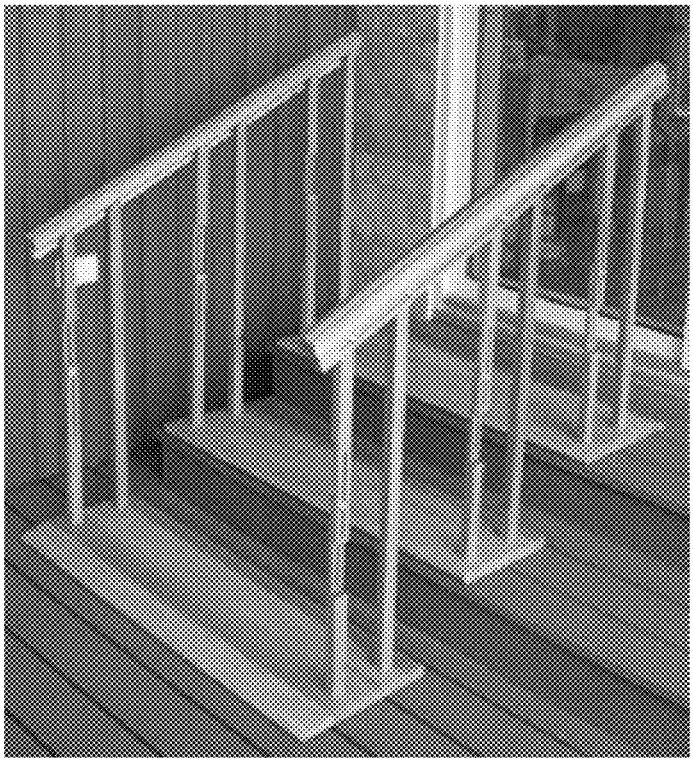
FIGS. 9 and 10 show installations of the stair system in accordance with the present invention.
Figure 10:
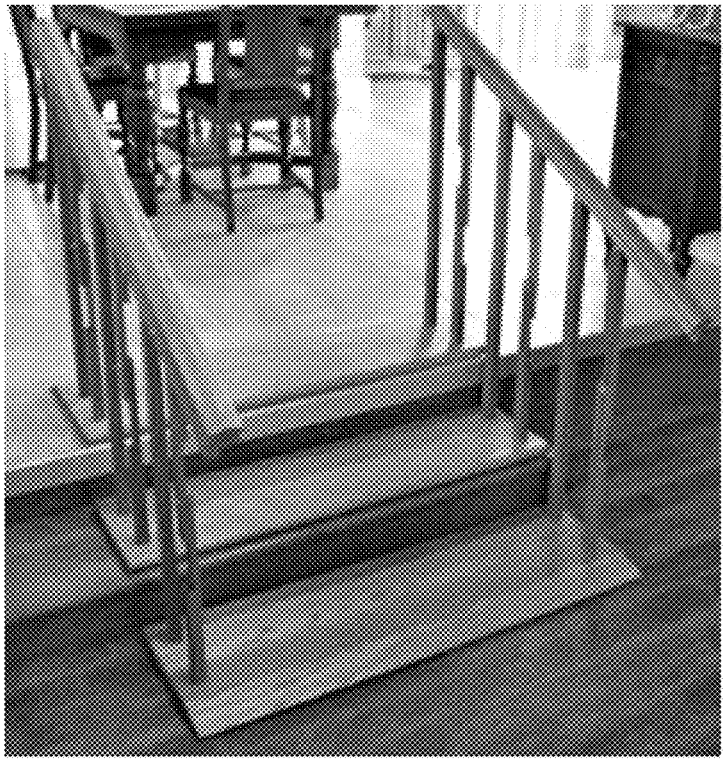

In other embodiments of the present invention, FIGS. 9 and 10 show embodiments of the present invention installed over existing stair systems.

While illustrative and presently preferred embodiment(s) of the invention have been described in detail hereinabove, it is to be understood that the inventive concepts may be otherwise variously embodied and employed and that the appended claims are intended to be construed to include such variations except insofar as limited by the prior art.

The invention claimed is:

1. A stair apparatus providing temporary support for going up and down stairs comprising:

at least two oversteps, at least one hand railing, at least two hand railing supports, and a hand railing angle adjustment, wherein each hand railing support comprises a first end and a second end, wherein the first end is attached to an overstep and the second end is attached to one hand railing, wherein each of the at least one hand railing is attached to two hand railing supports per overstep, wherein one hand railing support is of adjustable height, and wherein the stair apparatus is installed on top of existing stairs and is removable.

2. The stair apparatus of claim 1, wherein the stair apparatus further comprises at least one half step to facilitate going up and down the stairs by a user.

3. The stair apparatus of claim 2, wherein the half step further comprises an anchoring support for fixation to at least one of the hand railing supports.

4. The stair apparatus of claim 1, wherein the at least one hand railing further comprises grooves to allow a tighter grip.

5. The stair apparatus of claim 1, wherein the stair apparatus comprises one bottom or first overstep and one top or last overstep, wherein each of the bottom and top oversteps comprises an attachment to prevent tripping.

6. The stair apparatus of claim 1, wherein the stair apparatus further comprises at least one intermediate overstep, wherein the hand railing supports attached to the intermediate overstep are of adjustable height.

7. The stair apparatus of claim 1, wherein the other hand railing support is of fixed height.

8. A system for providing temporary support for going up and down stairs, the system comprising:

at least two oversteps, at least one hand railing, at least two hand railing supports, and a hand railing angle adjustment, wherein the at least one hand railing comprises premade holes, wherein the at least one hand railing support comprises premade slots or openings for assembly purposes, wherein the system is removable, and wherein each of the at least one hand railing is attached to two hand railing supports per overstep, wherein one hand railing support is of adjustable height.

9. The system for providing temporary support for going up and down stairs of claim 8, wherein the angle adjustment is adapted to an existing installation.

10. The system for providing temporary support for going up and down stairs of claim 9, wherein the angle adjustment is achieved by using at least one hand railing support of adjustable height per overstep.

11. The system for providing temporary support for going up and down stairs of claim 8, wherein the system further comprises at least one half step to facilitate going up and down the stairs by a user.

12. The system for providing temporary support for going up and down stairs of claim 11, wherein the half step comprises an anchoring support for fixation to at least one of the hand railing supports.

13. The system for providing temporary support for going up and down stairs of claim 8, wherein the system further comprises an attachment to prevent tripping, wherein the attachment is placed on a bottom overstep and/or on a top overstep.

14. The system for providing temporary support for going up and down stairs of claim 8, wherein the at least one hand railing comprises grooves to allow a tighter grip.

15. Use of a stair apparatus to provide temporary support for elderly people and those with mobility issues for going up and down stairs, the stair apparatus comprising:

at least two oversteps, at least one hand railing, and a hand rail angle adjustment, wherein each hand railing support is attached to one hand railing and to one overstep, and wherein each of the at least one hand railing is attached to two hand railing supports per overstep, wherein one hand railing support is of adjustable height.

16. The use of the stair apparatus of claim 15, wherein the stair apparatus further comprises at least one half step to facilitate going up and down the stairs by a user.

17. The use of the stair apparatus of claim 16, wherein the half step further comprises an anchoring support for fixation to at least one of the hand railing supports.

18. The use of the stair apparatus of claim 15, wherein the at least one hand railing further comprises grooves to allow a tighter grip.

19. The use of the stair apparatus of claim 15, wherein the stair apparatus comprises one bottom or first overstep and one top or last overstep, wherein each of the bottom and top oversteps comprises an attachment to prevent tripping.

* * * * *